US010047567B2

(12) United States Patent
Scott et al.

(10) Patent No.: US 10,047,567 B2
(45) Date of Patent: Aug. 14, 2018

(54) CUTTING ELEMENTS, RELATED METHODS OF FORMING A CUTTING ELEMENT, AND RELATED EARTH-BORING TOOLS

(71) Applicant: Baker Hughes Incorporated, Houston, TX (US)

(72) Inventors: Danny E. Scott, Montgomery, TX (US); Derek L. Nelms, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 812 days.

(21) Appl. No.: 13/953,307

(22) Filed: Jul. 29, 2013

(65) Prior Publication Data

US 2015/0027787 A1 Jan. 29, 2015

(51) Int. Cl.

| | |
|---|---|
| ***E21B 10/567*** | (2006.01) |
| ***B24D 18/00*** | (2006.01) |
| ***B24D 99/00*** | (2010.01) |
| ***E21B 10/56*** | (2006.01) |
| ***E21B 10/46*** | (2006.01) |

(52) U.S. Cl.

CPC ..... *E21B 10/567* (2013.01); *B24D 18/0009* (2013.01); *B24D 99/005* (2013.01); *E21B 10/46* (2013.01); *E21B 10/56* (2013.01)

(58) Field of Classification Search

CPC ..... E21B 10/46; E21B 10/56; E21B 10/567
USPC ..... 428/105, 156, 161, 212, 218, 409, 411.1
See application file for complete search history.

(56) References Cited

U.S. PATENT DOCUMENTS

| | | | |
|---|---|---|---|
| 4,224,380 | A | 9/1980 | Bovenkerk et al. |
| 5,127,923 | A | 7/1992 | Bunting et al. |
| 8,277,722 | B2 | 10/2012 | DiGiovanni |
| 8,496,076 | B2 | 7/2013 | DiGiovanni et al. |
| 8,579,052 | B2 | 11/2013 | DiGiovanni et al. |
| 8,662,209 | B2 | 3/2014 | Dourfaye et al. |
| 8,727,042 | B2 | 5/2014 | DiGiovanni |
| 8,763,731 | B2 | 7/2014 | Scott et al. |
| 2010/0186304 | A1 | 7/2010 | Burgess et al. |
| 2010/0307069 | A1 | 12/2010 | Bertagnolli et al. |

(Continued)

FOREIGN PATENT DOCUMENTS

| | | | |
|---|---|---|---|
| CN | 1252021 | A | 5/2000 |
| CN | 1807668 | A | 7/2006 |

(Continued)

OTHER PUBLICATIONS

International Search Report for the International Search Report for International Application No. PCT/US2014/048525 dated Nov. 14, 2014, 4 pages.

(Continued)

*Primary Examiner* — Nicole Coy
*Assistant Examiner* — Tara E Schimpf
(74) *Attorney, Agent, or Firm* — TraskBritt

(57) ABSTRACT

A cutting element comprises a supporting substrate, and a polycrystalline compact attached to an end of the supporting substrate. The polycrystalline compact comprises a region adjacent the end of the supporting substrate, and another region at least substantially laterally circumscribing the region and having lesser permeability than the region. A method of forming a cutting element, and an earth-boring tool are also described.

17 Claims, 8 Drawing Sheets

(56) References Cited

U.S. PATENT DOCUMENTS

| | | | | |
|---|---|---|---|---|
| 2010/0320006 | A1* | 12/2010 | Fan | B24D 99/005 175/428 |
| 2011/0042149 | A1 | 2/2011 | Scott et al. | |
| 2011/0088954 | A1* | 4/2011 | DiGiovanni | C04B 35/52 175/336 |
| 2011/0266059 | A1* | 11/2011 | DiGiovanni | B24D 99/005 175/57 |
| 2012/0037431 | A1* | 2/2012 | DiGiovanni | E21B 10/5676 175/428 |
| 2012/0080239 | A1 | 4/2012 | Lyons et al. | |
| 2012/0186885 | A1* | 7/2012 | Scott | B22F 3/14 175/428 |
| 2012/0222363 | A1 | 9/2012 | DiGiovanni et al. | |
| 2012/0222364 | A1 | 9/2012 | Lyons et al. | |
| 2012/0225277 | A1 | 9/2012 | Scott | |
| 2012/0261197 | A1 | 10/2012 | Miess et al. | |
| 2013/0092454 | A1 | 4/2013 | Scott et al. | |
| 2014/0069726 | A1 | 3/2014 | Mumma et al. | |
| 2014/0318027 | A1 | 10/2014 | Sani | |
| 2014/0338985 | A1 | 11/2014 | Gonzalez et al. | |
| 2015/0027787 | A1 | 1/2015 | Scott et al. | |
| 2015/0075877 | A1 | 3/2015 | Setlur et al. | |
| 2015/0136495 | A1 | 5/2015 | Knuteson et al. | |
| 2015/0211306 | A1 | 7/2015 | Mukhopadhyay et al. | |

FOREIGN PATENT DOCUMENTS

| | | | |
|---|---|---|---|
| CN | 101589207 | A | 11/2009 |
| CN | 101523014 | B | 2/2013 |
| RU | 2066729 | C1 | 9/1996 |

OTHER PUBLICATIONS

International Written Opinion for the International Search Report for International Application No. PCT/US2014/048525 dated Nov. 14, 2014, 8 pages.

Underwood, Ervin E., Quantitative Stereology, Addison-Wesley Publishing Company, Inc., 1970, 20 pages.

Scott, Danny E., Polycrystalline Diamond Compacts Having Leah Depths Selected to Control Physical Properties and methods of Offering such Compacts, U.S. Appl. No. 14/815,608, filed Jul. 31, 2015.

Supplementary European Search Report and Opinion from EP Application No. 14832395, dated Feb. 6, 2017, 9 pages.

Chinese First Search for Chinese Application No. 201480050908.1, dated Feb. 28, 2017, 1 page.

Chinese First Office Action for Chinese Application No. 201480050908.1, dated Mar. 9, 2017, 22 pages.

* cited by examiner

CUTTING ELEMENTS, RELATED METHODS OF FORMING A CUTTING ELEMENT, AND RELATED EARTH-BORING TOOLS

CROSS-REFERENCE TO RELATED APPLICATION

This application is related to U.S. patent application Ser. No. 14/815,608, filed Jul. 31, 2015, pending, titled "Polycrystalline Diamond Compacts Having Leach Depths Selected to Control Physical Properties and Methods of Forming Such Compacts."

TECHNICAL FIELD

Embodiments of the disclosure relate to cutting elements, to related methods of forming a cutting element, and to related earth-boring tools.

BACKGROUND

Earth-boring tools for forming wellbores in subterranean earth formations may include a plurality of cutting elements secured to a body. For example, fixed-cutter earth-boring rotary drill bits ("drag bits") include a plurality of cutting elements that are fixedly attached to a bit body of the drill bit. Similarly, roller cone earth-boring rotary drill bits may include cones that are mounted on bearing pins extending from legs of a bit body such that each cone is capable of rotating about the bearing pin on which it is mounted. A plurality of cutting elements may be mounted to each cone of the drill bit. Other earth-boring tools utilizing cutting elements include, for example, core bits, bi-center bits, eccentric bits, hybrid bits (e.g., rolling components in combination with fixed cutting elements), reamers, and casing milling tools.

The cutting elements used in such earth-boring tools often include a volume of polycrystalline diamond ("PCD") material on a substrate. Surfaces of the polycrystalline diamond act as cutting faces of the so-called polycrystalline diamond compact ("PDC") cutting elements. PCD material is material that includes inter-bonded grains or crystals of diamond material. In other words, PCD material includes direct, inter-granular bonds between the grains or crystals of diamond material. The terms "grain" and "crystal" are used synonymously and interchangeably herein.

PDC cutting elements are generally formed by sintering and bonding together relatively small diamond (synthetic, natural or a combination) grains, termed "grit," under conditions of high temperature and high pressure in the presence of a catalyst (e.g., cobalt, iron, nickel, or alloys and mixtures thereof) to form a layer (e.g., a "compact" or "table") of PCD material. These processes are often referred to as high temperature/high pressure (or "HTHP") processes. The supporting substrate may comprise a cermet material (i.e., a ceramic-metal composite material) such as, for example, cobalt-cemented tungsten carbide. In some instances, the PCD material may be formed on the cutting element, for example, during the HTHP process. In such instances, catalyst material (e.g., cobalt) in the supporting substrate may be "swept" into the diamond grains during sintering and serve as a catalyst material for forming the diamond table from the diamond grains. Powdered catalyst material may also be mixed with the diamond grains prior to sintering the grains together in an HTHP process. In other methods, the diamond table may be formed separately from the supporting substrate and subsequently attached thereto.

Upon formation of the diamond table using an HTHP process, catalyst material may remain in interstitial spaces between the inter-bonded grains of the PDC. The presence of the catalyst material in the PDC may contribute to thermal damage in the PDC when the PDC cutting element is heated during use due to friction at the contact point between the cutting element and the formation. Accordingly, the catalyst material (e.g., cobalt) may be leached out of the interstitial spaces using, for example, an acid or combination of acids (e.g., aqua regia). Substantially all of the catalyst material may be removed from the PDC, or catalyst material may be removed from only a portion thereof, for example, from a cutting face of the PDC, from a side of the PDC, or both, to a desired depth. Leaching rates and uniformity may at least partially depend on the permeability of the PDC to a leaching agent. The permeability of the PDC may be influenced by the porosity and mean free path of the PDC, which are in turn influenced by average grain size and grain distribution within the PDC. When a multi-layered or multi-regioned PDC is leached, coarser layers or regions exposed to the leaching agent may exhibit accelerated leach rates as compared to finer layers or regions. Unfortunately, such accelerated leaching can result in non-uniform leach depths within the PDC, and can also lead to defective cutting elements due to undesired removal of catalyst material from a supporting substrate attached to the PDC.

BRIEF SUMMARY

Embodiments described herein include cutting elements, methods of forming a cutting element, and earth-boring tools. For example, in accordance with one embodiment described herein, a cutting element comprises a supporting substrate, and a polycrystalline compact attached to an end of the supporting substrate. The polycrystalline compact comprises a region adjacent the end of the supporting substrate, and another region at least substantially laterally circumscribing the region and having lesser permeability than the region.

In additional embodiments, a method of forming a cutting element comprises providing a plurality of particles comprising a hard material into a container. Another plurality of particles is provided into the container, the another plurality of particles substantially laterally circumscribed by the plurality of particles. A supporting substrate is provided into the container over the plurality of particles and the another plurality of particles. The plurality of particles and the another plurality of particles of particles are sintered in the presence of a catalyst material to form a polycrystalline compact comprising a region adjacent an end of the supporting substrate, and another region substantially at least laterally circumscribing the region and having lesser permeability than the region. At least a portion of the catalyst material is removed from the polycrystalline compact.

In yet additional embodiments, the disclosure includes an earth-boring tool comprising at least one cutting element. The cutting element comprises a supporting substrate, and a polycrystalline compact attached to an end of the supporting substrate. The polycrystalline compact comprises a region adjacent the end of the supporting substrate, and another region at least substantially laterally circumscribing the region and having lesser permeability than the region.

DETAILED DESCRIPTION

Figure 1:
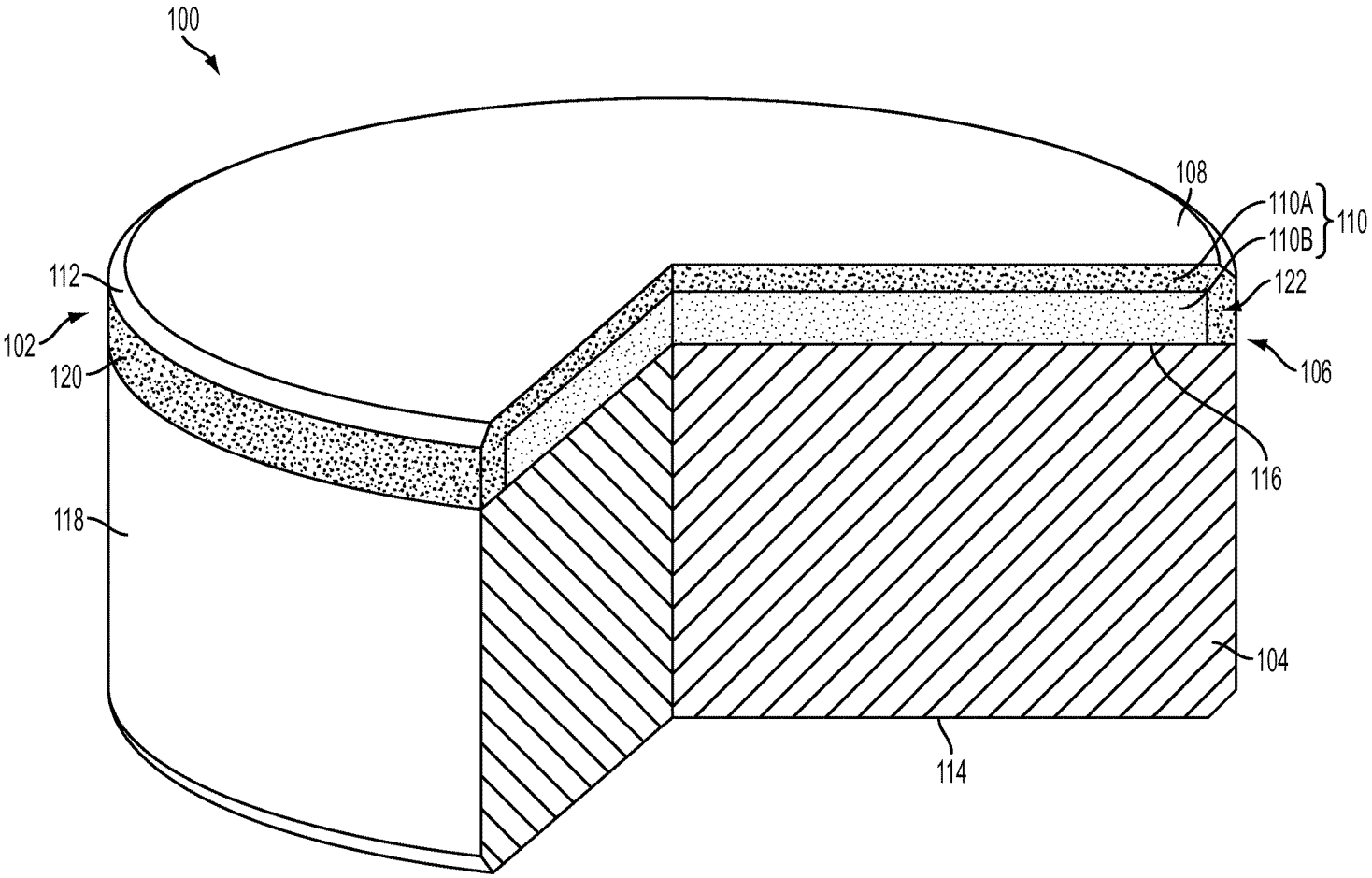
FIG. 1 is a partial cut-away perspective view of an embodiment of a cutting element in accordance with an embodiment of the disclosure.

Cutting elements for use in earth-boring tools are described, as are methods of forming cutting elements, and earth-boring tools. In some embodiments, a cutting element includes a polycrystalline compact attached to an end of a supporting substrate. The polycrystalline compact includes a first region extending from the supporting substrate, and laterally circumscribing a second region. The first region of the polycrystalline compact has reduced permeability as compared to the second region of the polycrystalline compact. During leaching processes, the structural geometry (i.e., shape) and permeability characteristics of the first region may facilitate improved leach rate uniformity and improved leach depth uniformity as compared to many conventional polycrystalline compacts, which may result in reduced damage to and defects in the cutting element, reduced fabrication scrap, and improved performance and reliability as compared to many conventional cutting elements and tools.

The following description provides specific details, such as material types and processing conditions in order to provide a thorough description of embodiments of the disclosure. However, a person of ordinary skill in the art will understand that the embodiments of the disclosure may be practiced without employing these specific details. Indeed, the embodiments of the disclosure may be practiced in conjunction with conventional fabrication techniques employed in the industry. In addition, the description provided below does not form a complete process flow for manufacturing a structure (e.g., cutting element), tool, or assembly. Only those process acts and structures necessary to understand the embodiments of the disclosure are described in detail below. Additional acts to form the complete structure, the complete tool, or the complete assembly from various structures may be performed by conventional fabrication techniques. Also note, any drawings accompanying the present application are for illustrative purposes only, and are thus not drawn to scale. Additionally, elements common between figures may retain the same numerical designation.

As used herein, the terms "comprising," "including," "containing," and grammatical equivalents thereof are inclusive or open-ended terms that do not exclude additional, unrecited elements or method steps, but also include the more restrictive terms "consisting of" and "consisting essentially of" and grammatical equivalents thereof. As used herein, the term "may" with respect to a material, structure, feature, or method act indicates that such is contemplated for use in implementation of an embodiment of the disclosure and such term is used in preference to the more restrictive term "is" so as to avoid any implication that other, compatible materials, structures, features and methods usable in combination therewith should or must be, excluded.

As used herein, the singular forms "a," "an," and "the" are intended to include the plural forms as well, unless the context clearly indicates otherwise.

As used herein, the teen "and/or" includes any and all combinations of one or more of the associated listed items.

As used herein, relational terms, such as "first," "second," "top," "bottom," "upper," "lower," "over," "under," etc., are used for clarity and convenience in understanding the disclosure and accompanying drawings and does not connote or depend on any specific preference, orientation, or order, except where the context clearly indicates otherwise.

As used herein, the term "substantially," in reference to a given parameter, property, or condition, means to a degree that one skilled in the art would understand that the given parameter, property, or condition is met with a small degree of variance, such as within acceptable manufacturing tolerances.

As used herein, the term "configured" refers to a shape, material composition, and arrangement of one or more of at least one structure and at least one apparatus facilitating operation of one or more of the structure and the apparatus in a predetermined or intended way.

As used herein, the terms "earth-boring tool" and "earth-boring drill bit" mean and include any type of bit or tool used for drilling during the formation or enlargement of a wellbore in a subterranean formation and include, for example, fixed-cutter bits, roller cone bits, percussion bits, core bits, eccentric bits, bicenter bits, reamers, mills, drag bits, hybrid bits (e.g., rolling components in combination with fixed cutting elements), and other drilling bits and tools known in the art.

As used herein, the term "polycrystalline compact" means and includes any structure comprising a polycrystalline material formed by a process that involves application of pressure (e.g., compaction) to the precursor material or materials used to fond the polycrystalline material. In turn, as used herein, the term "polycrystalline material" means and includes any material comprising a plurality of grains or crystals of the material that are bonded directly together by inter-granular bonds. The crystal structures of the individual grains of the material may be randomly oriented in space within the polycrystalline material.

As used herein, the term "inter-granular bond" means and includes any direct atomic bond (e.g., covalent, metallic, etc.) between atoms in adjacent grains of hard material.

As used herein, the term "hard material" means and includes any material having a Knoop hardness value of greater than or equal to about 3,000 $Kg/mm^2$ (29,420 MPa). Non-limiting examples of hard materials include diamond (e.g., natural diamond, synthetic diamond, or combinations thereof), or cubic boron nitride. Conversely, as used herein, the term "non-hard material" means and includes any material having a Knoop hardness value of less than about 3,000 $Kg_f/mm^2$ (29,420 MPa).

As used herein, the term "grain size" means and includes a geometric mean diameter measured from a 2D section through a bulk material. The geometric mean diameter for a group of particles may be determined using techniques known in the art, such as those set forth in Ervin E. Underwood, *Quantitative Stereology,* 103-105 (Addison-Wesley Publishing Company, Inc. 1970), which is incorporated herein in its entirety by this reference.

As used herein, the term "catalyst material" means and includes any material that is capable of substantially catalyzing the formation of inter-granular bonds between grains of hard material during an HTHP process, but at least contributes to the degradation of the inter-granular bonds and granular material under elevated temperatures, pressures, and other conditions that may be encountered in a drilling operation for forming a wellbore in a subterranean formation. For example, catalyst materials for diamond include cobalt, iron, nickel, other elements from Group VIIIA of the Periodic Table of the Elements, and alloys thereof.

As used herein, the term "green" means unsintered. Accordingly, as used herein, a "green" structure or region means and includes an unsintered structure or region comprising a plurality of discrete particles, which may be held together by a binder material, the unsintered structure having a size and shape allowing the formation of a part or component suitable for use in earth-boring applications from the structure by subsequent manufacturing processes including, but not limited to, machining and densification.

As used herein, the term "sintering" means temperature driven mass transport, which may include densification and/or coarsening of a particulate component, and typically involves removal of at least a portion of the pores between the starting particles (accompanied by shrinkage) combined with coalescence and bonding between adjacent particles.

FIG. 1 illustrates a cutting element 100 in accordance with embodiments as disclosed herein. The cutting element 100 includes a polycrystalline compact 102 bonded to a supporting substrate 104 at an interface 106. In additional embodiments, the polycrystalline compact 102 may be formed and/or employed without the supporting substrate 104. As depicted in FIG. 1, the cutting element 100 may be cylindrical or disc-shaped. In addition embodiments, the cutting element 100 may have a different shape, such as a dome, cone, or chisel shape.

The supporting substrate 104 may have a first end surface 114, a second end surface 116, and a generally cylindrical lateral side surface 118 extending between the first end surface 114 and the second end surface 116. As depicted in FIG. 1, the first end surface 114 and the second end surface 116 may be substantially planar. In additional embodiments, the first end surface 114 and/or the second end surface 116 (and, hence, the interface 106 between the supporting substrate 104 and the polycrystalline compact 102) may be non-planar. In addition, as shown in FIG. 1, the supporting substrate 104 may have a generally cylindrical shape. In additional embodiments, the supporting substrate 104 may have a different shape, such as a dome, cone, or chisel shape.

The supporting substrate 104 may be formed of include a material that is relatively hard and resistant to wear. By way of non-limiting example, the supporting substrate 104 may be formed from and include a ceramic-metal composite material (which are often referred to as "cermet" materials). In some embodiments, the supporting substrate 104 is formed of and includes a cemented carbide material, such as a cemented tungsten carbide material, in which tungsten carbide particles are cemented together in a metallic binder material. As used herein, the term "tungsten carbide" means any material composition that contains chemical compounds of tungsten and carbon, such as, for example, WC, $W_2C$, and combinations of WC and $W_2C$. Tungsten carbide includes, for example, cast tungsten carbide, sintered tungsten carbide, and macrocrystalline tungsten carbide. The metallic binder material may include, for example, a catalyst material such as cobalt, nickel, iron, or alloys and mixtures thereof. In at least some embodiments, the supporting substrate 104 is formed of and includes a cobalt-cemented tungsten carbide material.

The polycrystalline compact 102 may be disposed on or over the second end surface 116 of the supporting substrate 104. The polycrystalline compact 102 includes at least one lateral side surface 120 (also referred to as the "barrel" of the polycrystalline compact 102), and a cutting face 108 (also referred to as the "top" of the polycrystalline compact 102) opposite the second end surface 116 of the supporting substrate 104. The polycrystalline compact 102 may also include a chamfered edge 112 at a periphery of the cutting face 108. The chamfered edge 112 shown in FIG. 1 has a single chamfer surface, although the chamfered edge 112 also may have additional chamfer surfaces, and such chamfer surfaces may be oriented at chamfer angles that differ from the chamfer angle of the chamfered edge 112, as known in the art. Further, in lieu of a chamfered edge 112, one or more edges of the polycrystalline compact 102 may be rounded or comprise a combination of at least one chamfer surface and at least one arcuate surface. As illustrated in FIG. 1, the lateral side surface 120 of the polycrystalline compact 102 may be substantially coplanar with the lateral side surface 118 of the supporting substrate 104, and the cutting face 108 of the polycrystalline compact 102 may extend parallel to the first end surface 114 of the supporting substrate 104. Accordingly, the polycrystalline compact 102 may be cylindrical or disc-shaped. In addition embodiments, the polycrystalline compact 102 may have a different shape, such as a dome, cone, or chisel shape. The polycrystalline compact 102 may have a thickness within range of from about 1 millimeter (mm) to about 4 mm, such as from about 1.5 mm to about 3.0 mm. In some embodiments, the polycrystalline compact 102 has a thickness in the range of about 1.8 mm to about 2.2 mm.

The polycrystalline compact 102 may be formed of and include PCD material. The PCD material may comprise greater than or equal to about seventy percent (70%) by volume of the polycrystalline compact 102, such as greater than or equal to about eighty percent (80%) by volume of the polycrystalline compact 102, or greater than or equal to about ninety percent (90%) by volume of the polycrystalline compact 102. The PCD material may include grains or crystals of diamond (e.g., natural diamond, synthetic diamond, or a combination thereof) that are bonded together to form the polycrystalline compact 102, as described in further detail below. Interstitial spaces or regions between the grains of diamond may be filled with additional materials, or may be at least partially free of additional materials, as also described in further detail below. In further embodiments, the polycrystalline compact 102 may be formed of and include a different polycrystalline material, such as polycrystalline cubic boron nitride, carbon nitrides, and other hard materials known in the art.

With continued reference to FIG. 1, the polycrystalline compact 102 includes a plurality of regions 110. For example, as shown in FIG. 1, the polycrystalline compact 102 may include a first region 110A and a second region 110B. The first region 110A may extend inward from the cutting face 108 and the lateral side surface 120 of the polycrystalline compact 102. An annular extension 122 of the first region 110A may extend toward the supporting substrate 104 at a lateral periphery of the polycrystalline compact 102. In some embodiments, the annular extension 122 may abut the supporting substrate 104 at one or more portion(s) of the interface 106. The first region 110A may at least partially surround the second region 110B. In turn, the second region 110B may be disposed between at least a portion of the first region 110A and the supporting substrate 104. As depicted in FIG. 1, the first region 110A may substantially circumscribe upper and lateral (e.g., radially outer) portions of the second region 110B. Accordingly, in some embodiments, the second region 110B may not extend (e.g., laterally extend, and/or longitudinally extend) to the periphery (e.g., the cutting face 108, the chamfered edge 112, and the lateral side surface 120) of the polycrystalline compact 102. In further embodiments, a segment or portion of the second region 110B may be located between at least a portion of the annular extension 122 of first region 110A and the supporting substrate 104. The segment of the second region 110B may extend to the lateral side surface 120 of the polycrystalline compact 102, or may not extend to the lateral side surface 120 of the polycrystalline compact 102. As depicted in FIG. 1, interfaces between adjacent regions (e.g., the first region 110A and the second region 110B) of the plurality of regions 110 may be substantially planar. In additional embodiments, one or more interfaces between adjacent regions of the plurality of regions 110 may be non-planar.

Figure 2:
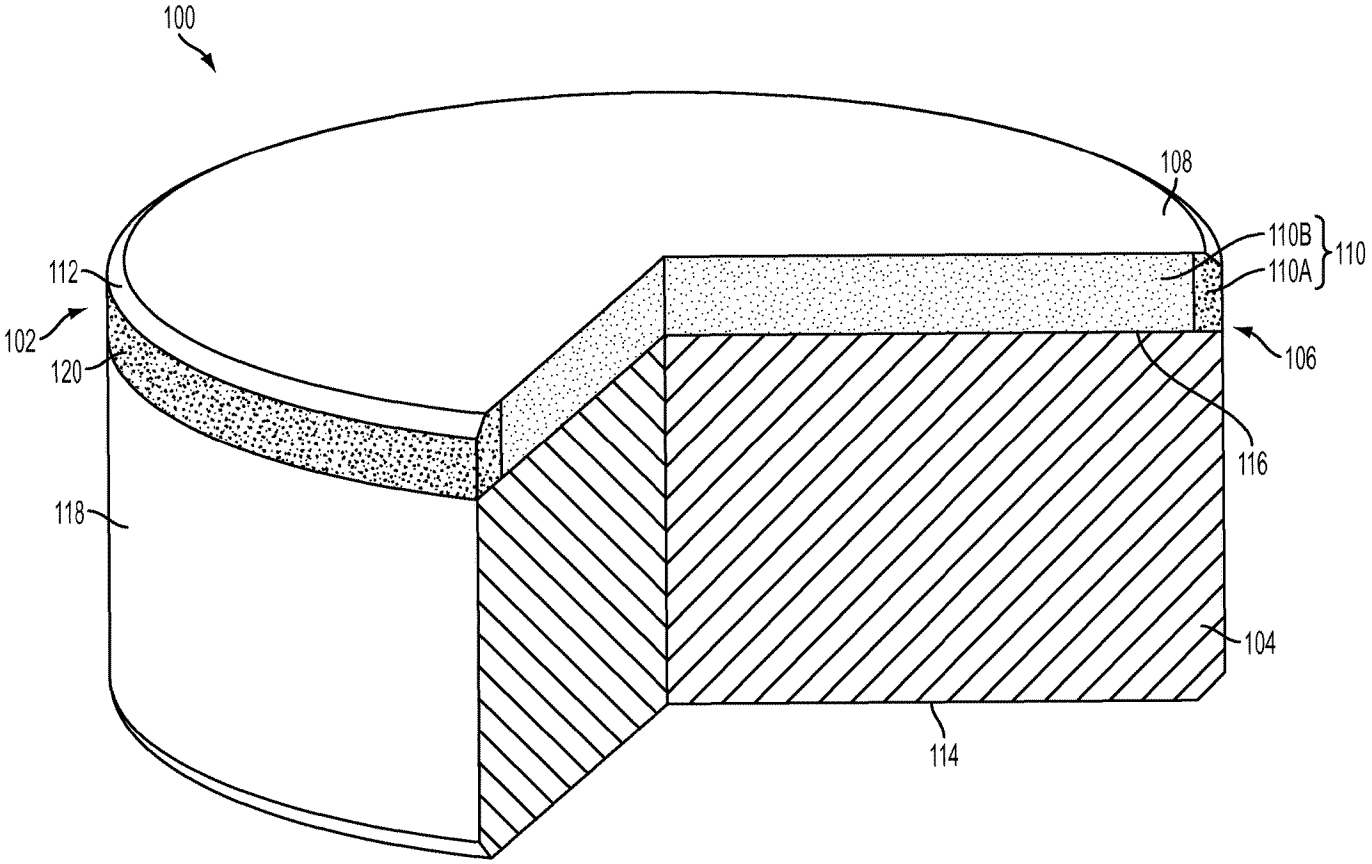
FIG. 2 is a partial cut-away perspective view of an embodiment of a cutting element in accordance with another embodiment of the disclosure.

Referring to FIG. 2, in additional embodiments, the polycrystalline compact 102 may exhibit a different configuration of the first region 110A and the second region 110B. For example, as depicted in FIG. 2, the first region 110A may extend inward from the lateral side surface 120 of the polycrystalline compact 102, but may not substantially extend inward from the cutting face 108 of the polycrystalline compact 102. The first region 110A may substantially circumscribe radially or laterally outer portions of the second region 110B, but may cover less than an entirety of an upper portion of the second region 110B. Accordingly, the second region 110B may extend from and form at least portion of the cutting face 108 of the polycrystalline compact 102. As depicted in FIG. 2, the second region 110B may form an entirety of the cutting face 108 of the polycrystalline compact 102, and the first region 110A may form an entirety of the lateral side surface 120 and the chamfered edge 112 of the polycrystalline compact 102. In additional embodiments, the second region 110B may form an entirety of the cutting face 108 and the chamfered edge 112 of the polycrystalline compact 102, and the first region 110A may form at least a portion of the lateral side surface 120 of the polycrystalline compact 102. The first region 110A may, for example, abut the supporting substrate 104, and may extend from the supporting substrate 104 to or below the chamfered edge 112 of the polycrystalline compact 102. In additional embodiments, the second region 110B may form a portion of the cutting face 108 of the polycrystalline compact 102, and the first region 110A may form an entirety of the lateral side surface 120 and the chamfered edge 112 of the polycrystalline compact 102, and may also form another portion of the cutting face 108 of the polycrystalline compact 102. As depicted in FIG. 2, interfaces between adjacent regions (e.g., between the first region 110A and the second region 110B) of the plurality of regions 110 may be substantially planar. In additional embodiments, one or more interfaces between adjacent regions of the plurality of regions 110 may be non-planar.

Figure 3:
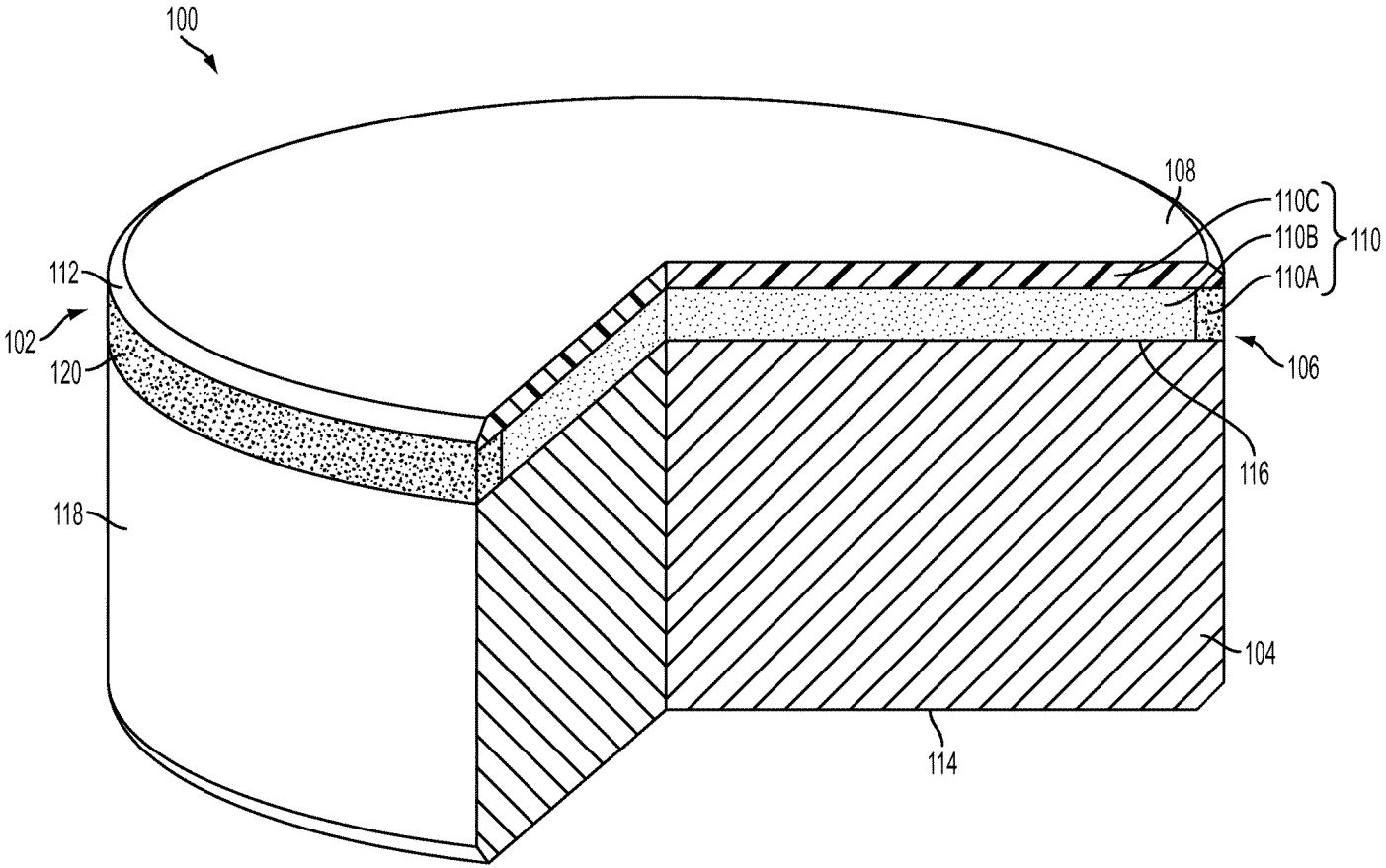
FIG. 3 is a partial cut-away perspective view of an embodiment of a cutting element in accordance with another embodiment of the disclosure.

Referring to FIG. 3, in further embodiments, the polycrystalline compact 102 may include additional regions. For example, as depicted in FIG. 3, the polycrystalline compact 102 may include the first region 110A, the second region 110B, and a third region 110C. The third region 110C may extend inward from the cutting face 108 of the polycrystalline compact 102, and the first region 110A may extend inward from the lateral side surface 120 of the polycrystalline compact 102. The third region 110C and first region 110A may at least partially surround the second region 110B. For example, the third region 110C may cover upper portions of the first region 110A and the second region 110B, and the first region 110A may circumscribe radially or laterally outer portions of the second region 110B. As depicted in FIG. 3, the third region 110C may form an entirety of the cutting face 108 and the chamfered edge 112 of the polycrystalline compact 102, and the first region 110A may form at least a portion of the lateral side surface 120 of the polycrystalline compact 102. The first region 110A may, for example, abut the supporting substrate 104, and may extend from the supporting substrate 104 to or below the chamfered edge 112 of the polycrystalline compact 102. In additional embodiments, the third region 110C may form less than an entirety of at least one of the cutting face 108 and the chamfered edge 112 of the polycrystalline compact 102. For example, the third region 110C may overly the second region 110B, and may be radially or laterally circumscribed by the first region 110A, such that the first region 110A extends to the cutting face 108 of the polycrystalline compact 102. In further embodiments, at least a portion of the third region 110C may circumscribe at least a portion of radially or laterally outer portions of at least one of the first region 110A and the second region 110B. As depicted in FIG. 3, interfaces between adjacent regions (e.g., between the first region 110A and the second region 110B, between the first region 110A and the third region 110C, between the second region 110B and the third region 110C, etc.) of the plurality of regions 110 may be substantially planar. In additional embodiments, one or more interfaces between adjacent regions of the plurality of regions 110 may be non-planar.

Referring collectively to FIGS. 1 through 3, at least one region of the plurality of regions 110 of the polycrystalline compact 102 has a different permeability than at least one other region of the polycrystalline compact 102. By way of non-limiting example, the first region 110A in each of the embodiments depicted in FIGS. 1 through 3 may have reduced or lesser permeability as compared to that the second region 110B. The reduced permeability of at least one region of the plurality of regions 110 (e.g., the first region 110A) relative to at least one other region of the plurality of regions 110 (e.g., the second region 110B) may be at least partially controlled through the average grain size and grain distribution within each of the different regions of the plurality of regions 110, as described in further detail below. The permeability differences of the different regions of the plurality of regions 110, in conjunction with the previously described structural configurations of the polycrystalline compact 102 (e.g., the first region 110A circumscribing at least the radially or laterally outer portions of the second region 110B proximate the supporting substrate 104)

may enable material (e.g., catalyst material) to be removed from at least the first region 110A and the second region 110B at substantially the same rate (e.g., a substantially uniform rate), which may reduce damage to and defects in the cutting element 100.

Figure 4:
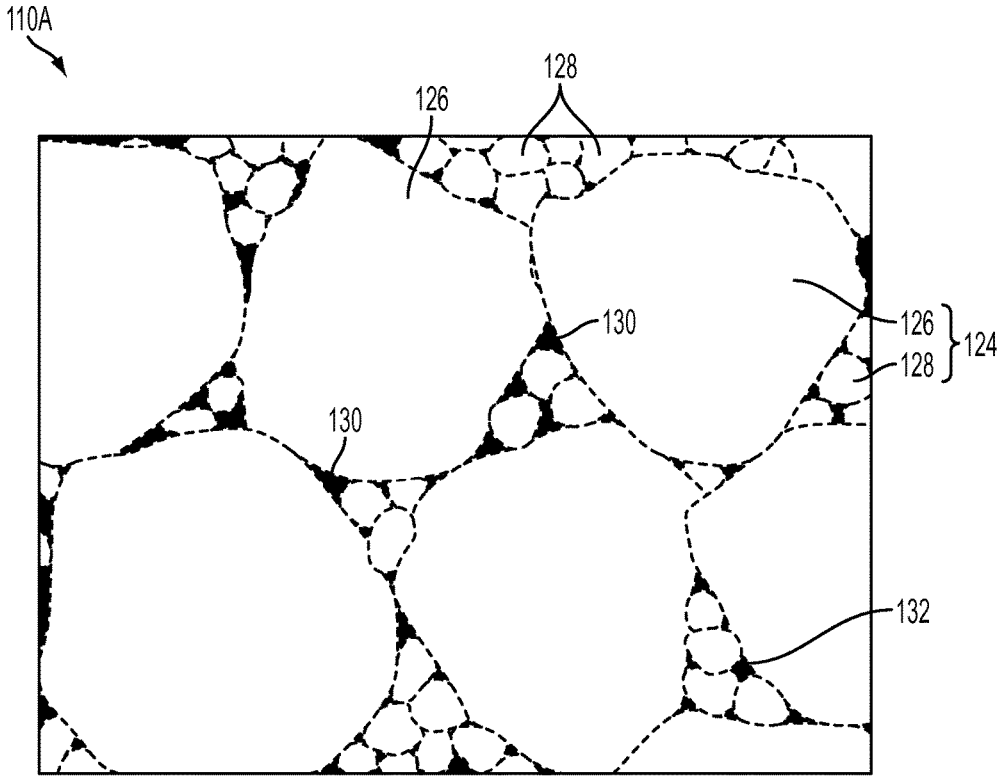
FIG. 4 is a simplified cross-sectional view illustrating how a microstructure of a region of a polycrystalline compact of the cutting element of any of FIGS. 1 through 3 may appear under magnification.

FIG. 4 is an enlarged view illustrating how a microstructure of the first region 110A shown in FIGS. 1 through 3 may appear under magnification. The first region 110A includes interspersed and inter-bonded grains 124 that form a three-dimensional network of polycrystalline material. The grains 124 may have a multi-modal grain size distribution. For example, as depicted in FIG. 4, the first region 110A may include larger grains 126 and smaller grains 128. In additional embodiments, the grains 124 may have a mono-modal grain size distribution (e.g., the smaller grains 128 may be omitted). Direct inter-granular bonds between the larger grains 126 and the smaller grains 128 are represented in FIG. 4 by dashed lines 130. The larger grains 126 may be formed of and include hard material. The larger grains 126 may be monodisperse, wherein all the larger grains 126 are of substantially the same size, or may be polydisperse, wherein the larger grains 126 have a range of sizes and are averaged. The smaller grains 128 may be formed of and include at least one of hard material and non-hard material. The smaller grains 128 may be monodisperse, wherein all the smaller grains 128 are of substantially the same size, or may be polydisperse, wherein the smaller grains 128 have a range of sizes and are averaged. The first region 110A may include from about 0.01% to about 99% by volume or weight smaller grains 128, such as from about 0.01% to about 50% by volume smaller grains 128, or from 0.1% to about 10% by weight smaller grains 128.

Interstitial spaces 132 (shaded black in FIG. 4) are present between the inter-bonded larger grains 126 and smaller grains 128 of the first region 110A. The interstitial spaces 132 may be at least partially filled with a solid material, such as at least one of a catalyst material and a carbon-free material. In at least some embodiments, the solid material of the interstitial spaces 132 may vary throughout a thickness of the first region 110A. For example, the interstitial spaces 132 proximate the interface 106 (FIGS. 1 through 3) of the supporting substrate 104 (FIGS. 1 through 3) and the polycrystalline compact 102 (FIGS. 1 through 3) may be filled with a first solid material (e.g., a catalyst material) and the interstitial spaces 132 proximate peripheral or exposed surfaces of the polycrystalline compact 102, such as the cutting face 108 and/or the lateral side surface 120 (FIGS. 1 through 3), may be filled with a second solid material (e.g., an inert solid filler material). At least some of the interstitial spaces 132 may be filled with a combination of the first solid material and the second solid material. In additional embodiments, at least some of the interstitial spaces 132 may comprise empty voids within the first region 110A in which there is no solid or liquid substance (although a gas, such as air, may be present in the voids). Such empty voids may be formed by removing (e.g., leaching) solid material from the interstitial spaces 132 after forming the polycrystalline compact 102, as described in further detail below. For example, catalyst material may have been leached from the interstitial spaces 132 of the first region 110A to a depth less than or equal to a depth of an interface between the first region 110A and the second region 110B (FIGS. 1 through 3). In some embodiments, the interstitial spaces 132 of the first region 110A are substantially free of catalyst material.

Figure 5:
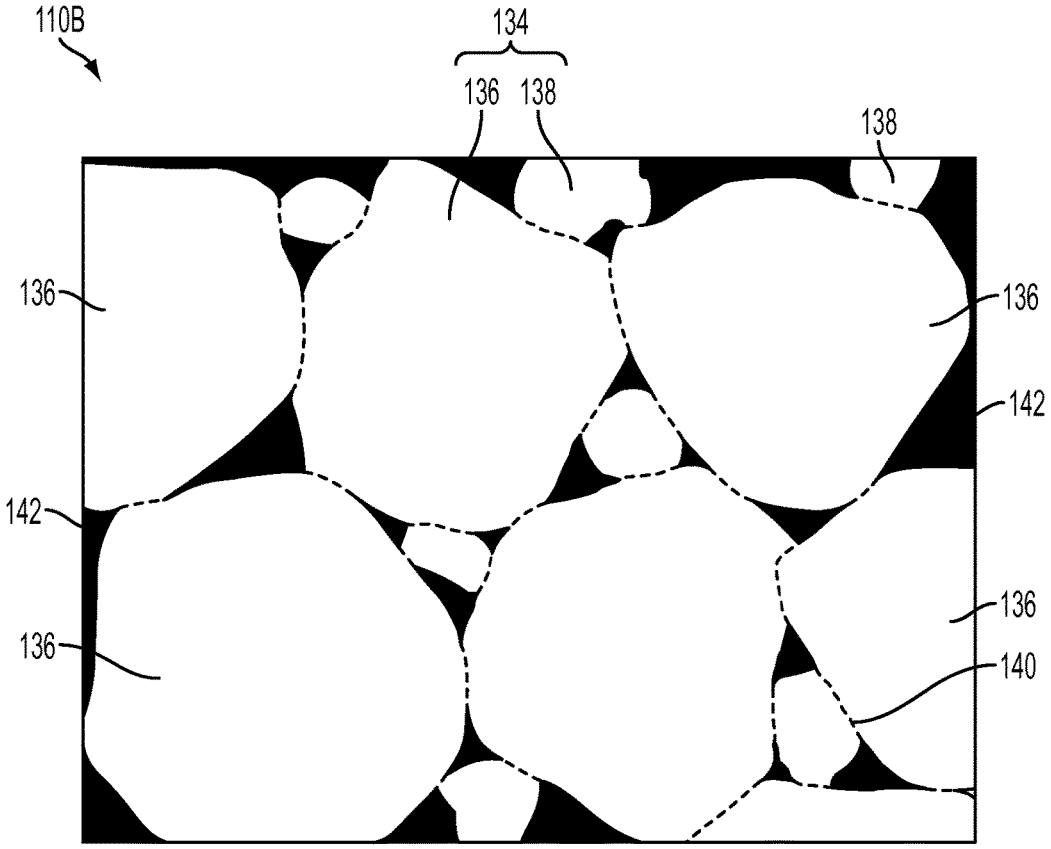
FIG. 5 is a simplified cross-sectional view illustrating how a microstructure of another region of the polycrystalline compact of the cutting element of any of FIGS. 1 through 3 may appear under magnification.

FIG. 5 is an enlarged view illustrating how a microstructure of the second region 110B of the polycrystalline compact 102, shown in FIGS. 1 through 3, may appear under magnification. The second region 110B includes interspersed and inter-bonded grains 134 that form a three-dimensional network of polycrystalline material. As described in further detail below, the average grain size of the grains 134 may be larger than the average grain size of the grains 124 (FIG. 4) of the first region 110A (FIG. 4). The grains 134 of the second region 110B may have a multi-modal grain size distribution. For example, as depicted in FIG. 5, the second region 110B may include larger grains 136 and smaller grains 138. In additional embodiments, the grains 134 may have a mono-modal grain size distribution (e.g., the smaller grains 138 may be omitted). Direct inter-granular bonds between the larger grains 136 and the smaller grains 138 are represented in FIG. 5 by dashed lines 140. The larger grains 136 may be formed of and include hard material. The larger grains 136 may be formed of the same material as the larger grains 126 of the first region 110A, or at least a portion of the larger grains 136 may be formed of a different material than the larger grains 126 of the first region 110A. The larger grains 136 may be monodisperse, wherein all the larger grains 136 are of substantially the same size, or may be polydisperse, wherein the larger grains 136 have a range of sizes and are averaged. In some embodiments, the average grain size of the larger grains 136 is greater than the average grain size of the larger grains 126 of the first region 110A. In additional embodiments, the average grain size of the larger grains 136 is substantially the same as the average grain size of the larger grains 126 of the first region 110A. The smaller grains 138 may be formed of and include at least one of hard material and non-hard material. The smaller grains 138 may be formed of the same material as the smaller grains 128 of the first region 110A, or at least a portion of the smaller grains 138 may be formed of and include a different material than the smaller grains 128 of the first region 110A. The smaller grains 138 may be monodisperse, wherein all the smaller grains 138 are of substantially the same size, or may be polydisperse, wherein the smaller grains 138 have a range of sizes and are averaged. In some embodiments, the average grain size of the smaller grains 138 is greater than the average grain size of the smaller grains 128 of the first region 110A. In additional embodiments, the average grain size of the smaller grains 138 is substantially the same as the average grain size of the smaller grains 128 of the first region 110A. The second region 110B may include from about 0.01% to about 99% by volume or weight smaller grains 138, such as from about 0.01% to about 50% by volume smaller grains 138, or from 0.1% to about 10% by weight smaller grains 138.

Interstitial spaces 142 (shaded black in FIG. 5) are present between the inter-bonded larger grains 136 and smaller grains 138 of the second region 110B. As described in further detail below, the interstitial spaces 142 may be larger than the interstitial spaces 132 of the first region 110A, and/or may comprise a greater volume percentage of the second region 110B than a volume percentage of the interstitial spaces 132 in first region 110A. The interstitial spaces 142 may be at least partially filled with a solid material, such as at least one of a catalyst material and a carbon-free material. In at least some embodiments, the solid material within the interstitial spaces 142 may vary throughout a thickness of the second region 110B. For example, the interstitial spaces 142 proximate the interface 106 (FIG. 1) of the supporting substrate 104 (FIG. 1) and the polycrystalline compact 102 may be filled with a first solid material (e.g., a catalyst) and the interstitial spaces 142 more proximate peripheral or exposed surfaces of the polycrystalline compact 102, such as the cutting face 108 (FIG. 1) and/or the lateral side surface 120 (FIG. 1), may be filled with a second solid material (e.g., an inert solid material). At least some of the interstitial spaces 142 may be filled with a combination of the first solid material and the second solid material. The solid material within the interstitial spaces 142 may be substantially the same as the solid material within the interstitial spaces 132 of the first region 110A, or the solid material within at least some of the interstitial spaces 142 may be different than the solid material within at least some of the interstitial spaces 132 of the first region 110A. In additional embodiments, at least some of the interstitial spaces 142 may comprise empty voids within the second region 110B in which there is no solid or liquid substance (although a gas, such as air, may be present in the voids). Such empty voids may be formed by removing (e.g., leaching) solid material out from the interstitial spaces 142 after forming the polycrystalline compact 102, as described in further detail below. In some embodiments, the interstitial spaces 142 of the second region 110B are substantially filled with catalyst material. Catalyst material may, for example, be leached from the interstitial spaces 132 (FIG. 4) and at least a portion (e.g., an entirety, or less than an entirety) of the first region 110A (FIGS. 1 through 4), but may substantially remain within the interstitial spaces 142 of the second region 110B.

Referring collectively to FIGS. 1 through 5, the first region 110A may have a lesser or reduced permeability relative to at least the second region 110B because the first region 110A may include a greater volume percentage of the grains 124 (FIG. 4) as compared to a volume percentage of the grains 134 (FIG. 5) in the second region 110B. The first region 110A may, for example, comprise greater than or equal to about 92% by volume of the grains 124, and the second region 110B may comprise less than or equal to about 91% by volume of the grains 134. By way of non-limiting example, the first region 110A may comprise from about 96% to about 99% by volume of the grains 124, and the second region 110B may comprise from about 85% to about 95% by volume of the grains 134. Accordingly, the first region 110A may comprise a relatively smaller volume percentage of interstitial spaces among the interbonded grains 124 as compared to the volume percentage of interstitial spaces among the interbonded grains 134 of the second region 110B. Where the first region 110A includes a relatively greater volume percentage of the grains 124, there may be fewer and/or smaller interstitial spaces 132 among the grains 124 as compared to the interstitial spaces 142 among the grains 134 of the second region 110B, resulting in fewer and/or more constricted paths for a leaching agent to penetrate.

With continued reference to FIGS. 1 through 5, the first region 110A may have a lesser or reduced permeability relative to at least the second region 110B because an average grain size of the grains 124 of first region 110A may be smaller than an average grain size of the grains 134 of the second region 110B. By way of non-limiting example, the average grain size of the grains 124 of the first region 110A may be less than or equal to about 15 micrometers (μm) (e.g., within a range of from about 5 μm to about 15 μm, from about 10 μm to about 15 μm, or from about 10 μm to about 12 μm), and the average grain size of the grains 134 of the second region 110B may be greater than about 15 μm (e.g., within a range of from about 15 μm to about 30 μm, from about 15 μm to about 20 μm, or from about 18 μm to about 20 μm). In some embodiments, the average grain size of the grains 124 of the first region 110A is within a range of from about 10 μm to about 12 μm, and the average grain size of the grains 134 of the second region 110B is within a range of from about 15 μm to about 20 μm. In additional embodiments, at least some of the grains 124 of the first region 110A and/or at least some of the grains 134 of the second region 110B may comprise nano-sized grains (i.e., grains having a diameter less than about 500 nanometers). Where the average grain size of the grains 124 of the first region 110A is smaller than the average grain size of the grains 134 of the second region 110B, there may be fewer and/or smaller interstitial spaces 132 among the grains 124 of the first region 110A as compared to the interstitial spaces 142 among the grains 134 of the second region 110B, resulting in fewer and/or more constricted paths for a leaching agent to penetrate. In addition, the use of a multi-modal size distribution of grains 124 in the first region 110A may result in fewer and/or smaller interstitial spaces 132 among the grains 124 of the first region 110A as compared to the interstitial spaces 142 among the grains 134 of the second region 110B, resulting in fewer and/or more constricted paths for a leaching agent to penetrate.

With further reference to FIGS. 1 through 5, the first region 110A may have a lesser or reduced permeability relative to at least the second region 110B because the interstitial spaces 132 of the first region 110A may be relatively less interconnected as compared to the interstitial spaces 142 of the second region 110B. For example, a mean free path within the interstitial spaces 142 among the interbonded grains 134 of the second region 110B may be about 10% or greater, about 25% or greater, or even about 50% or greater than a mean free path within the interstitial spaces 132 among the interbonded grains 124 of the first region 110A. The mean free path within the interstitial spaces 142 among the interbonded grains 134 of the second region 110B and the mean free path within the interstitial spaces 132 among the interbonded grains 124 of the first region 110A may be determined using techniques known in the art, such as those set forth in Ervin E. Underwood, *Quantitative Stereology*, (Addison-Wesley Publishing Company, Inc. 1970), which is incorporated herein in its entirety by this reference.

In embodiments where the polycrystalline compact 102 includes more than two regions, each progressively radially or laterally outward region of the polycrystalline compact 102 may abut and extend from the supporting substrate 104, and may have progressively reduced permeability (e.g., as influenced at least by the volume percentage of grains, average grain size, and grain distribution within each progressively radially or laterally outward region) relative to the permeability of at least one other region of the polycrystalline compact 102 disposed radially or laterally inward therefrom. Furthermore, in embodiments where the polycrystalline compact 102 includes at least one region overlying at least two radially or laterally disposed regions, such as the third region 110C in the embodiment depicted in FIG. 3, the at least one region (e.g., the third region 110C) may have a permeability substantially similar to one or more of the regions thereunder, or may have a permeability different than the regions thereunder. By way of non-limiting example, referring to FIG. 3, the third region 110C may have a different permeability than at least one of the first region 110A and the second region 110B, such as a permeability less than that of at least one of the first region 110A and the second region 110B (e.g., less than each of the first region 110A and the second region 110B, or substantially similar to that of the first region 110A and less than that of the second region 110B), or a permeability greater than that of at least one of the first region 110A and the second region 110B (e.g., greater than each of the first region 110A and the second region 110B, or substantially similar to that of the second region 110B and greater than that of the first region 110A).

An embodiment of a method of forming a cutting element 100 (FIGS. 1 through 3) of the disclosure will now be described with reference to FIG. 6, which illustrates a cross-sectional view of a container 144 in a process of forming the polycrystalline compact 102 illustrated in FIG. 1. A first plurality of particles 146 to become the interconnected grains 124 (FIG. 4) of the first region 110A (FIGS. 1 and 4) of the polycrystalline compact 102 (FIG. 1) may be formed or provided within the container 144, a second plurality of particles 148 to become the interconnected grains 134 (FIG. 5) of the second region 110B (FIGS. 1 and 5) of the polycrystalline compact 102 (FIG. 1) may be formed or provided within the container 144 adjacent to the first plurality of particles 146, and the supporting substrate 104 may be formed or provided over the first plurality of particles 146 and the second plurality of particles 148.

The first plurality of particles 146 may formed or provided within the container 144 in the shape of the first region 110A of the polycrystalline compact 102. For example, the first plurality of particles 146 may be bound together in the shape of the first region 110A with a suitable binder material. The binder material may comprise any material enabling the first plurality of particles 146 to be configured in the shape desired for the first region 110A of the polycrystalline compact 102, and which may be removed (e.g., volatilized off) during the initial stage of subsequent HTHP processing. In additional embodiments, the first plurality of particles 146 may be formed in the shape of the first region 110A without the use of a binder material. In some embodiments, the first plurality of particles 146 may be pressed (e.g., with or without binder material) to form a green first region 110A (e.g., a green structure exhibiting the general shape of the first region 110A) of the polycrystalline compact 102. During the pressing, a non-planar structure, such as, for example, a non-planar structure discussed previously in connection with FIGS. 1 through 3, may be imparted to the green first region 110A. The first plurality of particles 146 may have a multi-modal (e.g., bi-modal, tri-modal, etc.) particle size distribution, or may have a mono-modal particle size distribution. For example, the first plurality of particles 146 may include particles having a first average particle size, and particles having a second average particle size that differs from the first average particle size. The first plurality of particles 146 may comprise particles having relative and actual sizes as previously described with reference to the interconnected grains 124 of the first region 110A of the polycrystalline compact 102, although it is noted that some degree of grain growth and/or shrinkage may occur during subsequent processing (e.g., HTHP processing) used to form the polycrystalline compact 102.

The second plurality of particles 148 may formed or provided within the container 144 in the shape of the first region 110A of the polycrystalline compact 102. In some embodiments, the second plurality of particles 148 is formed or provided in the shape of the first region 110A of the polycrystalline compact 102 without the use of a binder material. For example, the second plurality of particles 148 may be provided into the container 144 as a plurality of substantially unbonded (e.g., flowable) particles. In additional embodiments, such as in embodiments where it is desired for the first region 110A of the polycrystalline compact 102 to have one or more non-planar portions or extensions (e.g., elevated portions and/or recessed portions), the second plurality of particles 148 may be bound together in the shape of the second region 110E with a suitable binder material. The binder material may be substantially the same as or different than the binder material used to bind together the first plurality of particles 146. The second plurality of particles 148 may, optionally, be pressed into a green second region 110B (e.g., a green structure exhibiting the general shape of the second region 110B) of the polycrystalline compact 102 in a manner substantially similar to that previously described in relation to the first plurality of particles 146. The first plurality of particles 146 may substantially radially or laterally circumscribe the second plurality of particles 148. As depicted in FIG. 6, in some embodiments, the first plurality of particles 146 may cup the second plurality of particles 148. The second plurality of particles 148 may have a multi-modal (e.g., bi-modal, tri-modal, etc.) particle size distribution, or may have a mono-modal particle size distribution. For example, the second plurality of particles 148 may include particles having a first average particle size, and particles having a second average particle size that differs from the first average particle size. The second plurality of particles 148 may comprise particles having relative and actual sizes as previously described with reference to the interconnected grains 134 of the second region 110B of the polycrystalline compact 102, although it is noted that some degree of grain growth and/or shrinkage may occur during subsequent processing (e.g., HTHP processing) used to form the polycrystalline compact 102.

Figure 6:
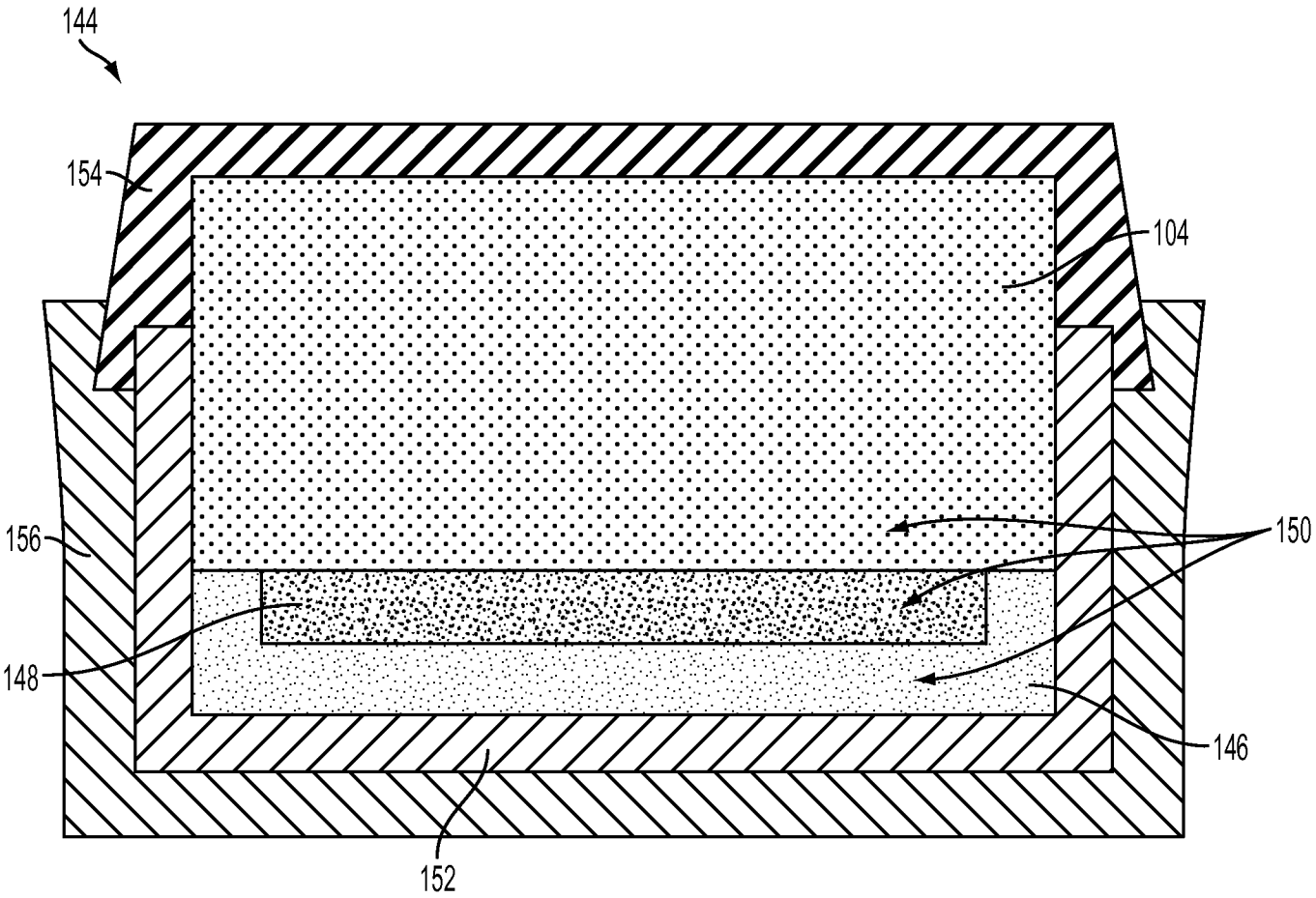
FIG. 6 is a simplified cross-sectional view of a container in a process of forming a cutting element, in accordance with an embodiment of the disclosure.

With continued reference to FIG. 6, a catalyst material 150, which may be used to catalyze formation of intergranular bonds among particles of the first plurality of particles 146 and the second plurality of particles 148 at a lesser temperature and pressure than might otherwise be required, may also be provided within the container 144. The catalyst material 150 may be provided within the supporting substrate 104, and, optionally, among at least one of the first plurality of particles 146 and the second plurality of particles 148. In some embodiments, the catalyst material 150 may be provided within at least one of the first plurality of particles 146 and the second plurality of particles 148 in the form of a dispersed catalyst powder. The average particle size of the catalyst powder may be selected such that a ratio of the average particle size of the catalyst powder to the average particle size of the particles with which the catalyst powder is mixed is within the range of from about 1:10 to about 1:1000, or even within the range from about 1:100 to about 1:1000, as disclosed in U.S. Patent Application Publication No. US 2010/0186,304 A1, which published Jul. 29, 2010 in the name of Burgess et al., now U.S. Pat. No. 8,435,317, issued May 7, 2013, and is incorporated herein in its entirety by this reference. Particles of catalyst material 150 may be mixed with at least one of the first plurality of particles 146, and the second plurality of particles 148 using techniques known in the art, such as standard milling techniques, by forming and mixing a slurry that includes the particles of catalyst material 150 and at least one of the first plurality of particles 146 and the second plurality of particles 148 in a liquid solvent, and subsequently drying the slurry, etc. In additional embodiments, the catalyst material 150 may comprise at least one catalyst foil or disc interposed between at least one of the supporting substrate 104, the first plurality of particles 146, and the second plurality of particles 148. In further embodiments, the catalyst material 150 may be coated on at least some particles of at least one of the first plurality of particles 146 and the second plurality of particles 148. Particles of at least one of the first plurality of particles 146 and the second plurality of particles 148 may be coated with the catalyst material 150 using a chemical solution deposition process, commonly known in the art as a sol-gel coating process.

As shown in FIG. 6, the container 144 may encapsulate the first plurality of particles 146, the second plurality of particles 148, and the supporting substrate 104. The container 144 may include an inner cup 152, in which at least a portion of each of the first plurality of particles 146, the second plurality of particles 148, and the supporting substrate 104 may each be disposed. The container 144 may further include a top end piece 154 and a bottom end piece 156, which may be assembled and bonded together (e.g., swage bonded) around the inner cup 152 with the first plurality of particles 146, the second plurality of particles 148, and the supporting substrate 104 therein. The sealed container 144 may then be subjected to an HTHP process, in accordance with procedures known in the art, to sinter the first plurality of particles 146 and the second plurality of particles 148 and form a cutting element 100 having a polycrystalline compact 102 including a first region 110A and a second region 110B generally as previously described with reference to FIGS. 1 through 3. For example, referring to FIGS. 1 and 6 together, the first plurality of particles 146 (FIG. 6) may form the first region 110A of the polycrystalline compact 102 (FIG. 1), and the second plurality of particles 148 (FIG. 6) may form the second region 110B of the polycrystalline compact 102 (FIG. 1).

Although the exact operating parameters of HTHP processes will vary depending on the particular compositions and quantities of the various materials being sintered, pressures in the heated press may be greater than or equal to about 5.0 GPa, and temperatures may be greater than or equal to about 1,400° C. In some embodiments, the pressures in the heated press may be greater than or equal to about 6.5 gigapascals (GPa), such as greater than or equal to about 6.7 GPa, or greater than or equal to about 8.0 GPa. Furthermore, the materials being sintered may be held at such temperatures and pressures for a time period between about 30 seconds and about 20 minutes.

Figure 7:
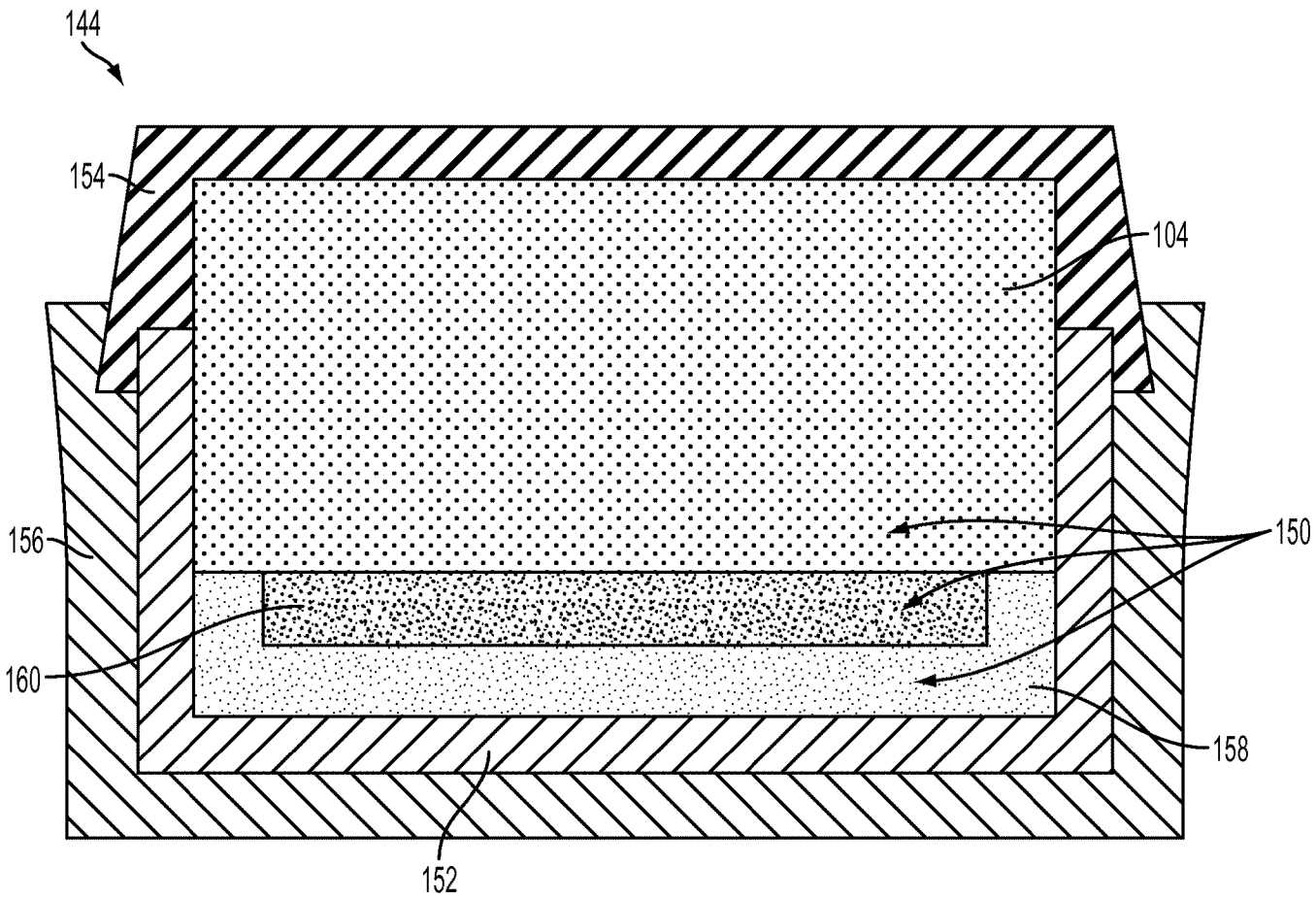
FIG. 7 is a simplified cross-sectional view of a container in a process of forming a cutting element, in accordance with an embodiment of the disclosure.

Another embodiment of a method of forming a cutting element 100 (FIGS. 1 through 3) of the disclosure will now be described with reference to FIG. 7, which illustrates a cross-sectional view of the container 144 in another process of forming the polycrystalline compact 102 illustrated in FIG. 1. A first separately formed polycrystalline compact 158 to become the first region 110A (FIG. 1) of the polycrystalline compact 102 (FIG. 1) may be provided within the container 144, a second separately formed polycrystalline compact 160 to become the second region 110B (FIG. 1) of the polycrystalline compact 102 (FIG. 1) may be provided within the container 144 adjacent to the first polycrystalline compact 158, and the supporting substrate 104 may be provided over the first polycrystalline compact 158 and the second polycrystalline compact 160. The first polycrystalline compact 158 may have a reduced permeability as compared to the second polycrystalline compact 160.

The first polycrystalline compact 158, the second polycrystalline compact 160, and the supporting substrate 104 may be subjected to a sintering process, such as, for example, an HTHP process as has been described previously, in the container 144. The first polycrystalline compact 158 and the second polycrystalline compact 160 may be sintered in the presence of catalyst material 150. The catalyst material 150 may remain in at least some interstitial spaces between interbonded grains of the first polycrystalline compact 158 and the second polycrystalline compact 160 after the original sintering process used to form the first polycrystalline compact 158 and the second polycrystalline compact 160. In some embodiments, however, at least one of the first polycrystalline compact 158 and the second polycrystalline compact 160 may be at least partially leached to remove at least some catalyst material 150 therefrom prior to being provided into the container 144. In additional embodiments, the catalyst material 150 may be provided in the form of a disc or foil interposed between at least one of the supporting substrate 104, first polycrystalline compact 158, and the second polycrystalline compact 160. The HTHP process may form a cutting element 100 having a polycrystalline compact 102 including a first region 110A and a second region 110B generally as previously described with reference to FIGS. 1 through 3. For example, referring to FIGS. 1 and 7 together, the first polycrystalline compact 158 (FIG. 7) may form the first region 110A of the polycrystalline compact 102 (FIG. 1), and the second polycrystalline compact 160 (FIG. 7) may form the second region 110B of the polycrystalline compact 102 (FIG. 1).

Referring collectively to FIGS. 1 through 7, after using the methods of the disclosure to form and attach a polycrystalline compact 102 (FIGS. 1 through 3) on a supporting substrate 104 (FIGS. 1 through 3), the polycrystalline compact 102 may be subjected to a leaching process to remove one or more solid material(s) from at least one of the plurality of regions 110 (FIGS. 1 through 3) of the polycrystalline compact 102. For example, a leaching agent may be used to remove catalyst material 150 (FIGS. 6 and 7) from the interstitial spaces 132 (FIG. 4) among the interconnected grains 124 (FIG. 4) of the first region 110A of the polycrystalline compact 102, and/or from the interstitial spaces 142 (FIG. 5) among the interconnected grains 134 (FIG. 5) of the second region 110B of the polycrystalline compact 102. Suitable leaching agents are known in the art and described more fully in, for example, U.S. Pat. No. 5,127,923 to Bunting et al. (issued Jul. 7, 1992), and U.S. Pat. No. 4,224,380 to Bovenkerk et al. (issued Sep. 23, 1980), the disclosure of each of which is incorporated herein in its entirety by this reference. By way of non-limiting example, at least one of aqua regia (i.e., a mixture of concentrated nitric acid and concentrated hydrochloric acid), boiling hydrochloric acid, and boiling hydrofluoric acid may be used as a leaching agent. In some embodiments, the leaching agent may comprise hydrochloric acid at a temperature greater than or equal to about 110° C. Surfaces of the cutting element 100 (FIGS. 1 through 3) other than those to be leached, such as surfaces of the supporting substrate 104, and/or predetermined surfaces of the polycrystalline compact 102, may be covered (e.g., coated) with a protective material, such as a polymer material, that is resistant to etching or other damage from the leaching agent. Exposed (e.g., unmasked) surfaces of the polycrystalline compact 102 (e.g., exposed portions of the cutting face 108, the chamfered edge 112, the lateral side surface 120, etc.) to be leached may be brought into contact with the leaching agent by, for example, dipping or immersion. The leaching agent may be provided in contact with the exposed surfaces of the polycrystalline compact 102 for a period of from about 30 minutes to about 60 hours, depending upon the size of the polycrystalline compact 102 and a desired depth of material removal.

With continued reference to FIGS. 1 through 7, in some embodiments, catalyst material 150 may be removed from the regions 110 of the polycrystalline compact 102 proximate at least one of the cutting face 108, the chamfered edge 112, the lateral side surface 120 to a depth of from about 40

μm to about 400 μm, such as from about 100 μm to about 250 μm. In additional embodiments, the regions 110 of the polycrystalline compact 102 may be "deep" leached to a depth of greater than about 250 μm. In further embodiments, the regions 110 of the polycrystalline compact 102 may be leached to a depth of less than about 100 μm. Removal of catalyst material 150 from one or more of the regions 110 of the polycrystalline compact 102 may enhance thermal stability of the polycrystalline compact 102 during use, as known to those of ordinary skill in the art. The presence of the catalyst material 150 in one or more other of the regions 110 of the polycrystalline compact 102 may enhance the durability and impact strength of the cutting element 100. In some embodiments, catalyst material 150 is removed from the interstitial spaces 132 (FIG. 4) among the interconnected grains 124 (FIG. 4) of the first region 110A of the polycrystalline compact 102, but is not substantially removed from the interstitial spaces 142 (FIG. 5) among the interconnected grains 134 (FIG. 5) of the second region 110A of the polycrystalline compact 102. For example, catalyst material 150 may be removed from the polycrystalline compact 102 to a depth less than or equal to a depth of an interface between the first region 110A and the second region 110B.

Advantageously, the structural configuration (i.e., shape) and permeability characteristics (e.g., as affected by the volume percentage of grains, average grain size, grain distribution, mean free path, etc.) of at least the first region 110A of the polycrystalline compact 102 may facilitate at least one of improved leach rate uniformity and improved leach depth uniformity as compared to many conventional polycrystalline compacts. For example, at least laterally circumscribing, if not laterally and longitudinally circumscribing, the second region 110B of the polycrystalline compact 102 with the first region 110A of the polycrystalline compact 102 may enable catalyst material 150 to be leached from at least lateral portions of the second region 110B at substantially the same rate as catalyst material is leached from at least lateral portions of the first region 110A. In turn, controlling leaching rates within the polycrystalline compact 102 may facilitate enhanced control of leaching depth, which may limit, if not preclude, undesired catalyst material 150 removal from the supporting substrate 104 that may otherwise result from the use of conventional polycrystalline compacts. In some embodiments, the configuration (e.g., shape and permeability characteristics) of the first region 110A relative to the second region 110B may substantially limit, if not prevent, leaching of catalyst material 150 from the second region 110B and the supporting substrate 104 (e.g., leaching of catalyst material 150 may be limited to the first region 110A). Such improvements may, in turn, relatively reduce damage to and defects in a cutting element 100 employing the polycrystalline compact 102, thereby reducing fabrication scrap (e.g., defective cutting elements that are disposed of because they fail to meet predetermined quality standards), and increasing the performance and reliability of the cutting element 100 and an earth-boring tool employing the cutting element 100.

Figure 8:
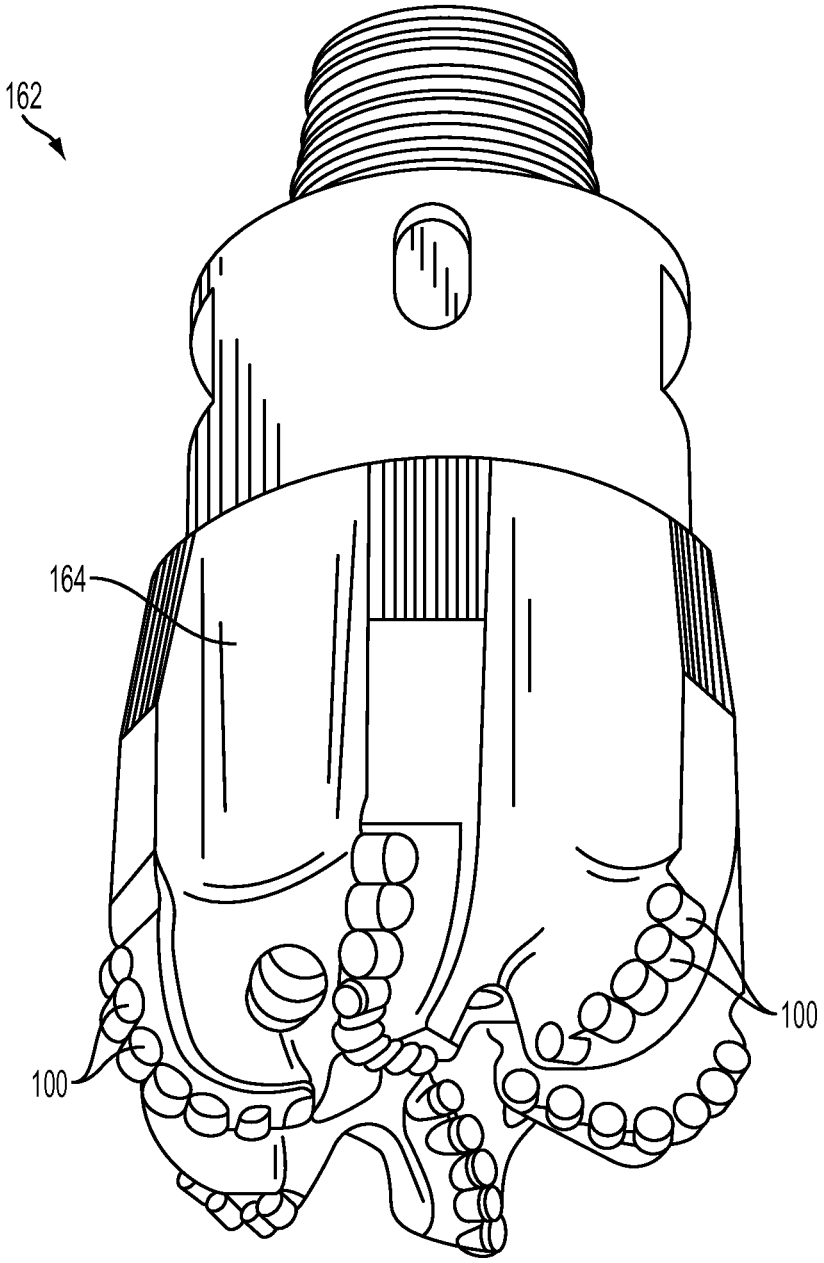
FIG. 8 is a perspective view of an embodiment of a fixed-cutter earth-boring rotary drill bit including a cutting element of the disclosure.

Embodiments of cutting elements 100 (e.g., FIGS. 1 through 3) described herein may be secured to an earth-boring tool and used to remove subterranean formation material in accordance with additional embodiments of the present disclosure. The earth-boring tool may, for example, be a rotary drill bit, a percussion bit, a coring bit, an eccentric bit, a reamer tool, a milling tool, etc. As a non-limiting example, FIG. 8 illustrates a fixed-cutter type earth-boring rotary drill bit 162 that includes a plurality of cutting elements 100 (FIGS. 1 through 3), each of which includes a polycrystalline compact 102 (e.g., FIGS. 1 through 3), as previously described herein. The rotary drill bit 162 includes a bit body 164, and the cutting elements 100 are bonded to the bit body 164. The cutting elements 100 may be brazed, welded, or otherwise secured, within pockets formed in the outer surface of the bit body 164.

While the disclosure has been described herein with respect to certain example embodiments, those of ordinary skill in the art will recognize and appreciate that it is not so limited. Rather, many additions, deletions and modifications to the embodiments described herein may be made without departing from the scope of the invention as hereinafter claimed. In addition, features from one embodiment may be combined with features of another embodiment while still being encompassed within the scope of the invention as contemplated by the inventor. Further, the invention has utility in drill bits having different bit profiles as well as different cutter types.

What is claimed is:

1. A cutting element, comprising:

a supporting substrate; and a polycrystalline compact attached to an upper surface of the supporting substrate and comprising:

a first region abutting the upper surface of the supporting substrate and comprising:

first interbonded larger grains comprising a first hard material;

first interbonded smaller grains comprising a first non-hard material; and first interstitial spaces between the first interbonded larger grains and the first interbonded smaller grains and substantially filled with a catalyst material;

a second region abutting each of lateral boundaries of the first region and the upper surface of the supporting substrate and defining a lower portion of an outermost side surface of the polycrystalline compact, the second region including an inner portion extending radially along the lateral boundaries of the first region and an outer portion extending radially between the inner portion and the outermost side surface of the polycrystalline compact, the second region having a smaller average grain size than the first region and comprising:

second interbonded larger grains comprising a second hard material;

second interbonded smaller grains comprising a second non-hard material; and second interstitial spaces between the second interbonded larger grains and the second interbonded smaller grains, the second interstitial spaces of the outer portion of the second region being substantially filled with an inert solid filler material, and only the outer portion of the second region being substantially free of the catalyst material; and an additional a third region abutting upper longitudinal boundaries of the first region and the second region and defining each of a cutting face of the polycrystalline compact and an upper portion of the outermost side surface of the polycrystalline compact, the third region having a different average grain size than the second region.

2. The cutting element of claim 1, wherein the first region comprises a first volume percentage of interconnected grains of material, and wherein the second region comprises a second, greater volume percentage of interconnected grains of material.

3. The cutting element of claim 1, wherein the first interstitial spaces of the first region have a first interconnectivity, and wherein the second interstitial spaces of the second region have a second, lesser interconnectivity.

4. The cutting element of claim 1, wherein the first region comprises a first volume percentage of the first interstitial spaces thereof, and wherein the second region comprises a second, smaller volume percentage of the second interstitial spaces thereof.

5. The cutting element of claim 1, wherein:

the second region abuts and completely covers entireties of the lateral boundaries of the first region; and the third region abuts and completely covers entireties of the upper longitudinal boundaries of the first region and the second region.

6. The cutting element of claim 1, wherein the second region longitudinally extends from the upper surface of the supporting substrate to a lower longitudinal boundary of the third region.

7. The cutting element of claim 1, wherein the second region completely encloses lateral boundaries of the first region from the upper surface of the supporting substrate to a lower longitudinal boundary of the third region.

8. The cutting element of claim 1, wherein the first region extends from the upper surface of the supporting substrate to a lower longitudinal boundary of the third region.

9. The cutting element of claim 1, wherein the second region of the polycrystalline compact comprises from about 0.1 percent by weight to about 10 percent by weight of the second interbonded smaller grains.

10. The cutting element of claim 1, wherein:

an average grain size of the first interbonded larger grains of the first region is greater than an average grain size of the second interbonded larger grains of the second region; and an average grain size of the first interbonded smaller grains of the first region is greater than an average grain size of the second interbonded smaller grains of the second region.

11. The cutting element of claim 1, wherein a material composition of the first non-hard material of the first interbonded smaller grains of the first region is different than that of the second non-hard material of the second interbonded smaller grains of the second region.

12. A method of forming a cutting element, comprising:

providing a first plurality of particles comprising a first hard material into a container;

providing a second plurality of particles into the container on the first plurality of particles;

providing a third plurality of particles into the container on the first plurality of particles and adjacent lateral boundaries of the second plurality of particles, the third plurality of particles having an average grain size different than that of the first plurality of particles and smaller than that of the second plurality of particles; and providing a supporting substrate into the container on the second plurality of particles and the third plurality of particles;

sintering the first plurality of particles, the second plurality of particles, and the third plurality of particles in the presence of a catalyst material to form a polycrystalline compact comprising:

a first region abutting an upper surface of the supporting substrate and comprising:

first interbonded larger grains comprising a first hard material;

first interbonded smaller grains comprising a first non-hard material; and first interstitial spaces between the first interbonded larger grains and the first interbonded smaller grains and substantially filled with a catalyst material;

a second region abutting each of lateral boundaries of the first region and the upper surface of the supporting substrate and defining a lower portion of an outermost side surface of the polycrystalline compact, the second region including an inner portion extending radially along the lateral boundaries of the first region and an outer portion extending radially between the inner portion and the outermost side surface of the polycrystalline compact, the second region having a smaller average grain size than the first region and comprising:

second interbonded larger grains comprising a second hard material;

second interbonded smaller grains comprising a second non-hard material; and second interstitial spaces between the second interbonded larger grains and the second interbonded smaller grains, the second interstitial spaces of the outer portion of the second region being substantially filled with an inert solid filler material, and only the outer portion of the second region being substantially free of the catalyst material; and a third region abutting upper longitudinal boundaries of the first region and the second region and defining each of a cutting face of the polycrystalline compact and an upper portion of the outermost side surface of the polycrystalline compact, the third region having a different average grain size than the second region.

13. The method of claim 12, wherein providing another the second plurality of particles into the container comprises forming the second plurality of particles into a desired shape of the first region.

14. The method of claim 13, wherein forming the second plurality of particles into a desired shape of the first region comprises pressing the second plurality of particles in the presence of a binder material to form a green structure of the desired shape prior to providing the third plurality of particles into the container.

15. The method claim 12, wherein providing the second plurality of particles into the container comprises providing the second plurality of particles into the container in a preform shape configured to be surrounded by the first plurality of particles and the third plurality of particles.

16. An earth-boring tool comprising at least one cutting element comprising:

a supporting substrate; and a polycrystalline compact attached to an upper surface of the supporting substrate and comprising:

a first region abutting the upper surface of the supporting substrate and comprising:

first interbonded larger grains comprising a first hard material;

first interbonded smaller grains comprising a first non-hard material; and first interstitial spaces between the first interbonded larger grains and the first interbonded smaller grains and substantially filled with a catalyst material;

a second region abutting each of lateral boundaries of the first region and the upper surface of the supporting substrate and defining a lower portion of an outermost side surface of the polycrystalline compact, the second region including an inner portion extending radially along the lateral boundaries of the first region and an outer portion extending radially between the inner portion and the outermost side surface of the polycrystalline compact, the second region having a smaller average grain size than the first region and comprising: second interbonded larger grains comprising a second hard material; second interbonded smaller grains comprising a second non-hard material; and second interstitial spaces between the second interbonded larger grains and the second interbonded smaller grains, the second interstitial spaces of the outer portion of the second region being substantially filled with an inert solid filler material, and only the outer portion of the second region being substantially free of the catalyst material; and a third region abutting upper longitudinal boundaries of the first region and the second region and defining each of a cutting face of the polycrystalline compact and an upper portion of the outermost side surface of the polycrystalline compact, the third region having a different average grain size than the second region.

17. The earth-boring tool of claim 16, wherein the earth-boring tool comprises an earth-boring rotary drill bit.

* * * * *